US008265313B2

(12) United States Patent
Korl

(10) Patent No.: US 8,265,313 B2
(45) Date of Patent: Sep. 11, 2012

(54) METHOD FOR FEEDBACK CANCELLING IN A HEARING DEVICE AND A HEARING DEVICE

(75) Inventor: Sascha Korl, Sargans (CH)

(73) Assignee: Phonak AG, Staefa (CH)

( * ) Notice: Subject to any disclaimer, the term of this patent is extended or adjusted under 35 U.S.C. 154(b) by 495 days.

(21) Appl. No.: 12/600,674

(22) PCT Filed: May 22, 2007

(86) PCT No.: PCT/EP2007/054942

§ 371 (c)(1),
(2), (4) Date: Nov. 18, 2009

(87) PCT Pub. No.: WO2007/125132

PCT Pub. Date: Nov. 8, 2007

(65) Prior Publication Data

US 2010/0150388 A1 Jun. 17, 2010

(51) Int. Cl.
*H04R 25/00* (2006.01)

(52) U.S. Cl. ..... 381/318; 381/83; 381/94.1

(58) Field of Classification Search ..... 381/318, 381/83, 94.1, 94.2, 94.3, 94.4, 94.5, 312, 381/317

See application file for complete search history.

(56) References Cited

U.S. PATENT DOCUMENTS 6,611,600 B1 8/2003 Leber et al.

FOREIGN PATENT DOCUMENTS

EP 1675374 A1 6/2006

OTHER PUBLICATIONS

International Search Report for PCT/EP2007/054942 dated Feb. 14, 2008.

Chankawee et al, "Performance Improvement of Acoustic Feedback Cancellation in Hearing Aids Using Linear Prediction," Tencon 2004, 2004 IEEE Region 10 Conference Chiang Mai, Thailand, Nov. 21, 2004, pp. 116-119, XP010797568.

Spriet et al, "Adaptive Feedback Cancellation in Hearing Aids with Linear Prediction of the Desired Signal," IEEE Transactions on Signal Processing, IEEE Service Center, NewYork, NY, US, vol. 53, No. 10, Oct. 2005, pp. 3749-3763, XP001238143.

*Primary Examiner* — Davetta W Goins
*Assistant Examiner* — Amir Etesam
(74) *Attorney, Agent, or Firm* — Pearne & Gordon LLP

(57) ABSTRACT

A method and a hearing device for cancelling or preventing feedback are disclosed. The hearing device comprises a microphone (1), a transfer function (2) and a receiver (3), wherein the transfer function (2) defines relation between an input signal (12) of the hearing device and an output signal (13, 13') of the hearing device. The method according to the present invention comprises the steps of estimating an external transfer function (21) of an external feedback path (11) defined by sound traveling from the receiver (3) to the microphone (1), estimating the input signal (12') having no feedback components of the external feedback path (11) using an auxiliary signal (15), which does not comprise feedback components of the external feedback path (11), and using the estimated input signal (14) for estimating the external transfer function (21) of the external feedback path (11).

19 Claims, 5 Drawing Sheets

METHOD FOR FEEDBACK CANCELLING IN A HEARING DEVICE AND A HEARING DEVICE

Figure 1:
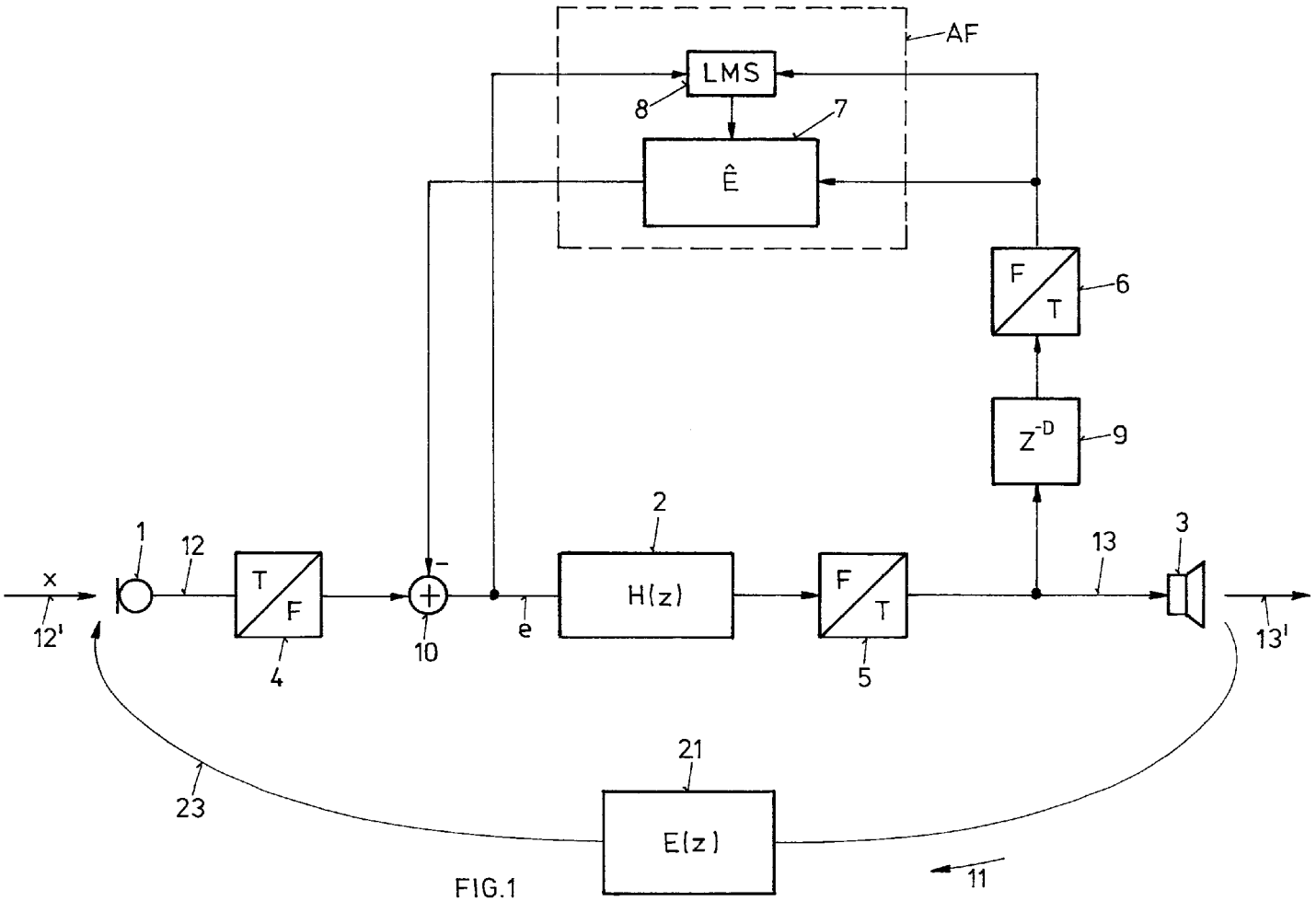

The present invention is related to a method for feedback cancelling according to the preamble of claim 1 as well as to a hearing device according to the preamble of claim 9.

One of the problems in today's hearing devices is the occurrence of howling due to acoustic feedback. Annoying feedback whistles occur when the output signal of the hearing device reaches the microphones, and the signal level at the microphones is higher than the original incoming signal. Very often, a gain is needed that is higher than an allowable gain, which limits the use of the hearing device. Not only hearing impaired subjects with a severe hearing loss are affected by this problem, but the trend to more open fittings affects an even greater number of hearing device users.

Acoustic feedback occurs in hearing devices when sound leaks from the vent or seal between the ear mould and the ear canal. In most cases, acoustic feedback is not audible. But when the gain of the hearing device is sufficiently high, or when a larger vent size is used, the output of the hearing device generated within the ear canal can exceed the attenuation offered by the ear mould. The output of the hearing device then becomes unstable and the once-inaudible acoustic feedback becomes audible, i.e. in the form of a whistling or howling sound. Mathematically, the system becomes unstable when the magnitude of the loop transfer function is greater or equal to one, and the phase is an integer multiple of $2\pi$. In other words, howling starts at those frequencies where the cycle duration matches the loop delay (hearing device and acoustic path) and the amplification is greater than one. In a typical hearing device setting the phase condition is fulfilled every 120 to 160 Hz.

For many hearing device users and people in the vicinity, such audible acoustic feedback is an annoyance and even an embarrassment. In addition, hearing devices that are at the verge of howling, i.e. show sub-oscillatory feedback, may corrupt the frequency characteristic and may exhibit intermittent whistling.

In U.S. Pat. No. 5,661,814 a feedback cancelling algorithm is discloses that is based on a LMS—(Least-Mean-Square) adaptive filter technique. The known teaching is very well suitable to cancel occurring feedback. Thereby, a negative effect on the transfer function of the hearing device has been observed in that the transfer function of the hearing device is corrupted, and, therewith, reduced speech intelligibility must be taken into account. Generally, algorithms, which are solely based on howling detection, are not capable of resolving the frequency response issue.

It is therefore one object of the present invention to not only cancel feedback, i.e. not only prevent howling due to feedback, but also to compensate for the negative effect of feedback cancelling on the transfer function of the hearing device.

This object and further objects have been achieved by the features given in the characterizing part of claim 1. Further embodiments as well as a hearing device are given in further claims.

The present invention is directed to a method for cancelling or preventing feedback in a hearing device comprising a microphone, a transfer function and a receiver, wherein the transfer function defines relation between an input signal of the hearing device and an output signal of the hearing device. The method according to the present invention comprises the steps of:

- estimating an external transfer function of an external feedback path defined by sound traveling from the receiver to the microphone,
- estimating the input signal having no feedback components of the external feedback path using an auxiliary signal, which does not comprise feedback components of the external feedback path, and
- using the estimated input signal for estimating the external transfer function of the external feedback path.

An embodiment of the present invention is characterized in that an adaptive filter using a Least-Mean-Square algorithm is implemented for estimating the external transfer function.

In a further embodiment, the present invention further comprises the steps of

- calculating an estimated feedback signal using the estimated external transfer function and the output signal of the hearing device, and
- subtracting the estimated feedback signal from an output signal of the microphone, the result of subtracting the estimated feedback signal from the output signal of the microphone being used to adjust the estimated external transfer function.

In another embodiment, the present invention is characterized in that one of the following signals is used as auxiliary signal:

- an output signal of a microphone of a contra-lateral hearing device;
- a combination of output signals of a contra-lateral or a remote microphone;
- a signal picked-up by a remote microphone.

In a further embodiment, the present invention is characterized in that a further adaptive filter, preferably using a Least-Mean-Square algorithm, is implemented for estimating the input signal having no feedback components.

In a further embodiment, the present invention is characterized by further comprising the step of using the input signal of the hearing device for estimating the input signal having no feedback components.

In a further embodiment, the present invention further comprises the step of subtracting the estimated input signal weighted by a first factor from the result of subtracting the estimated feedback signal from the output signal of the microphone, the first factor having a value between 0 and 1, preferably a value of 0.9.

In a further embodiment, the present invention further is characterized by further comprising the step of subtracting the estimated input signal or a processed estimated input signal from the output signal, the estimated input signal or the processed estimated input signal being weighted by a second factor that has a value between 0 and 1, preferably a value of 0.1.

In a further embodiment, the present invention is characterized by involving the transfer function in the processing of the estimated input signal.

Furthermore, a hearing device is disclosed comprising

- a microphone,
- a transfer function unit having a transfer function,
- a receiver,
- means for estimating an external transfer function of an external feedback path defined by sound traveling from the receiver to the microphone, wherein the transfer function defines relation between an input signal of the hearing device and an output signal of the hearing device,

- means for estimating the input signal having no feedback components of the external feedback path using an auxiliary signal, which does not comprise feedback components of the external feedback path, and
- operationally connecting the estimated input signal to the means for estimating the external transfer function of the external feedback path.

In an embodiment, the present invention is characterized by further comprising means for calculating an estimated feedback signal using the estimated external transfer function and the output signal of the hearing device, and means for subtracting the estimated feedback signal from an output signal of the microphone, the result of subtracting the estimated feedback signal from the output signal of the microphone being used to adjust the estimated external transfer function.

In a further embodiment, the present invention is characterized in that the auxiliary signal is one of the following signals:

an output signal of a microphone of a contra-lateral hearing device;

a combination of output signals of a contra-lateral or remote microphone;

a signal picked-up by a remote microphone.

In yet another embodiment, the present invention is characterized in that the means for estimating the input signal is a further adaptive filter.

In another embodiment, the present invention is characterized in that the input signal is operationally connected to the further adaptive filter.

In another embodiment, the present invention is characterized by further comprising means for subtracting the estimated input signal weighted by a first factor from the result of subtracting the estimated feedback signal from the output signal of the microphone, the first factor having a value between 0 and 1, preferably a value of 0.9.

In another embodiment, the present invention is characterized by further comprising means for subtracting the estimated input signal or a processed estimated input signal from the output signal, the estimated input signal or the processed estimated input signal being weighted by a second factor that has a value between 0 and 1, preferably a value of 0.1.

In another embodiment, the present invention is characterized in that the estimated input signal is fed to the transfer function unit for processing the estimated input signal.

The present invention will be further described by referring to drawings showing exemplified embodiments.

Figure 2:
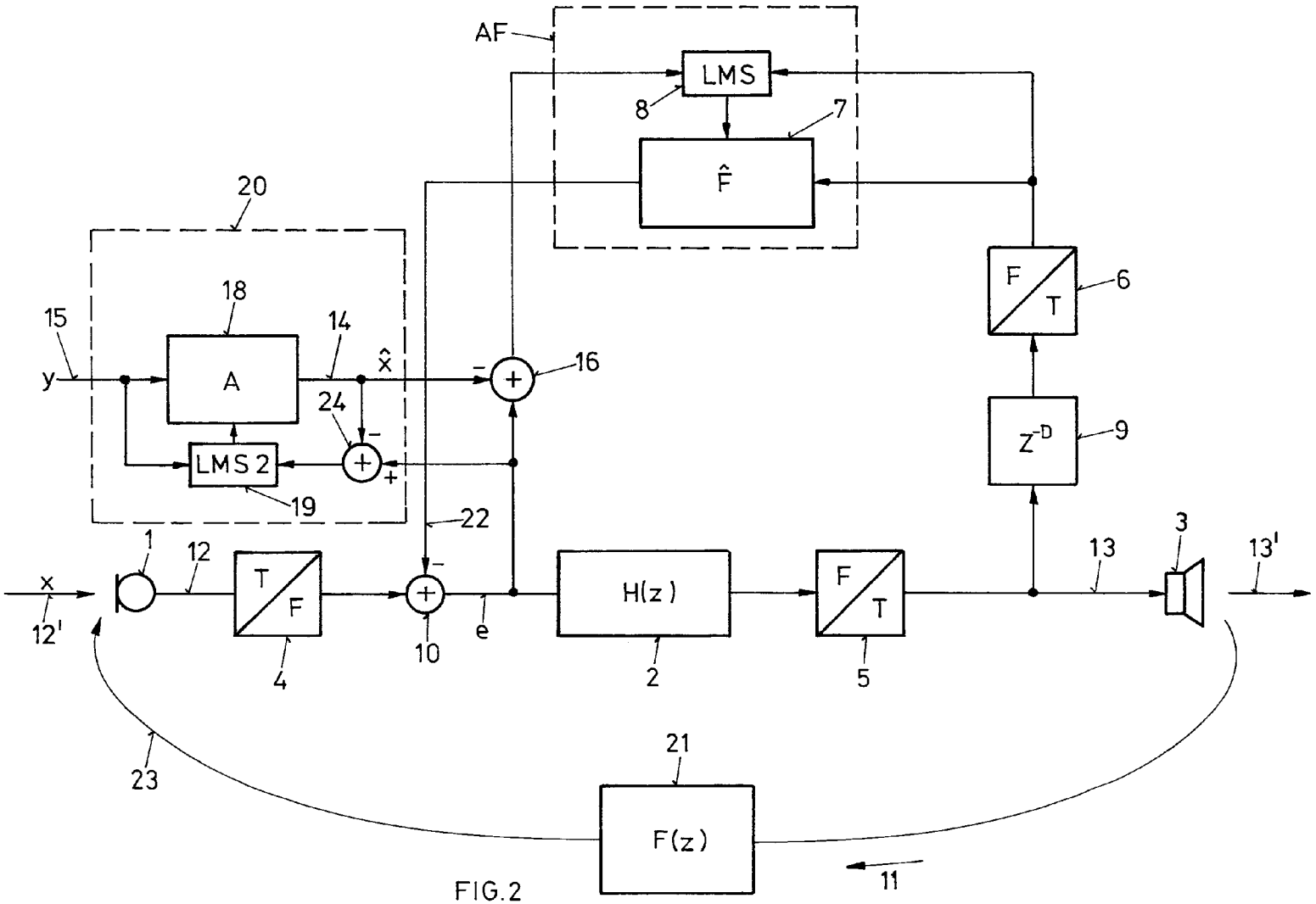
Figure 3:
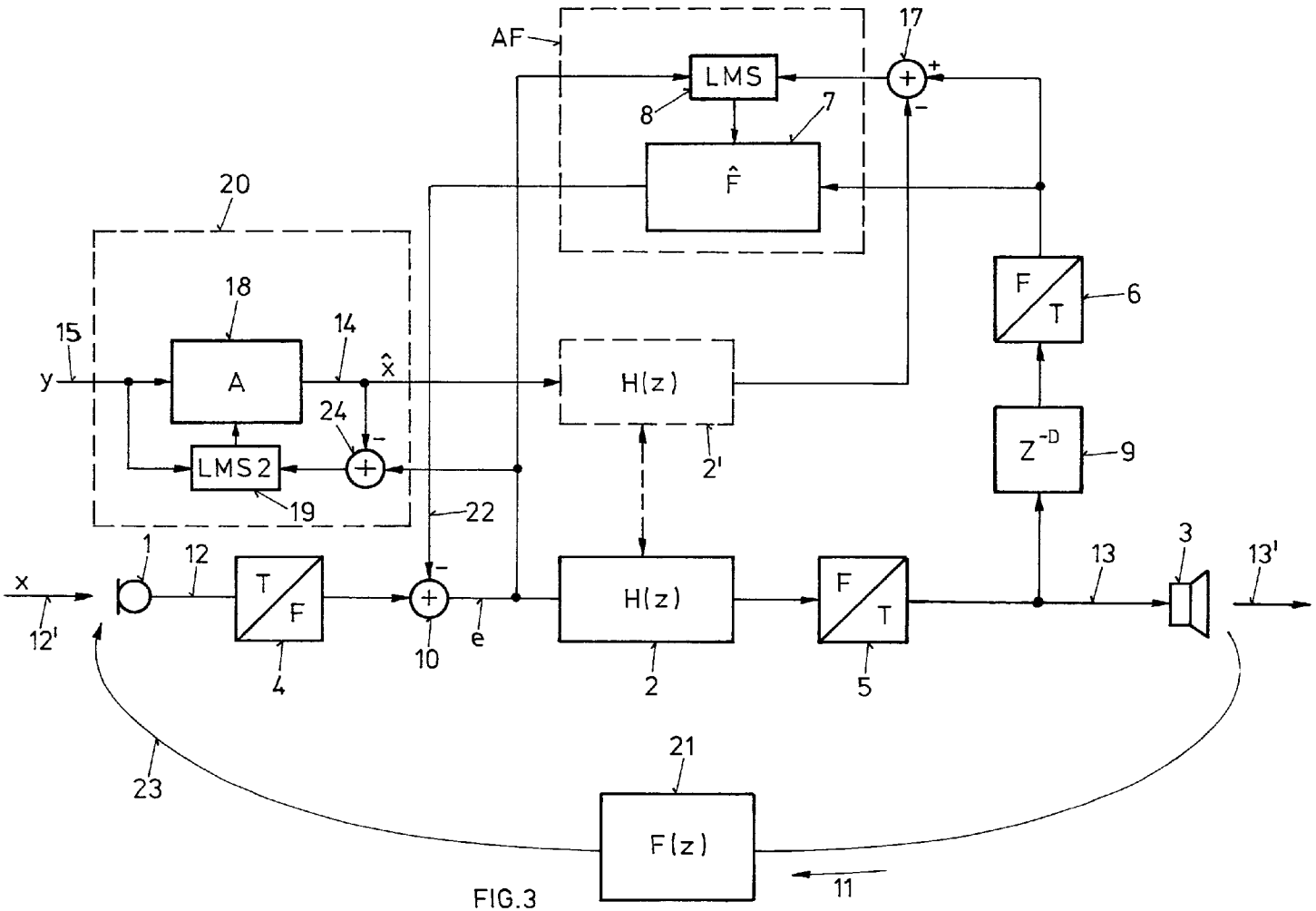
Figure 4:
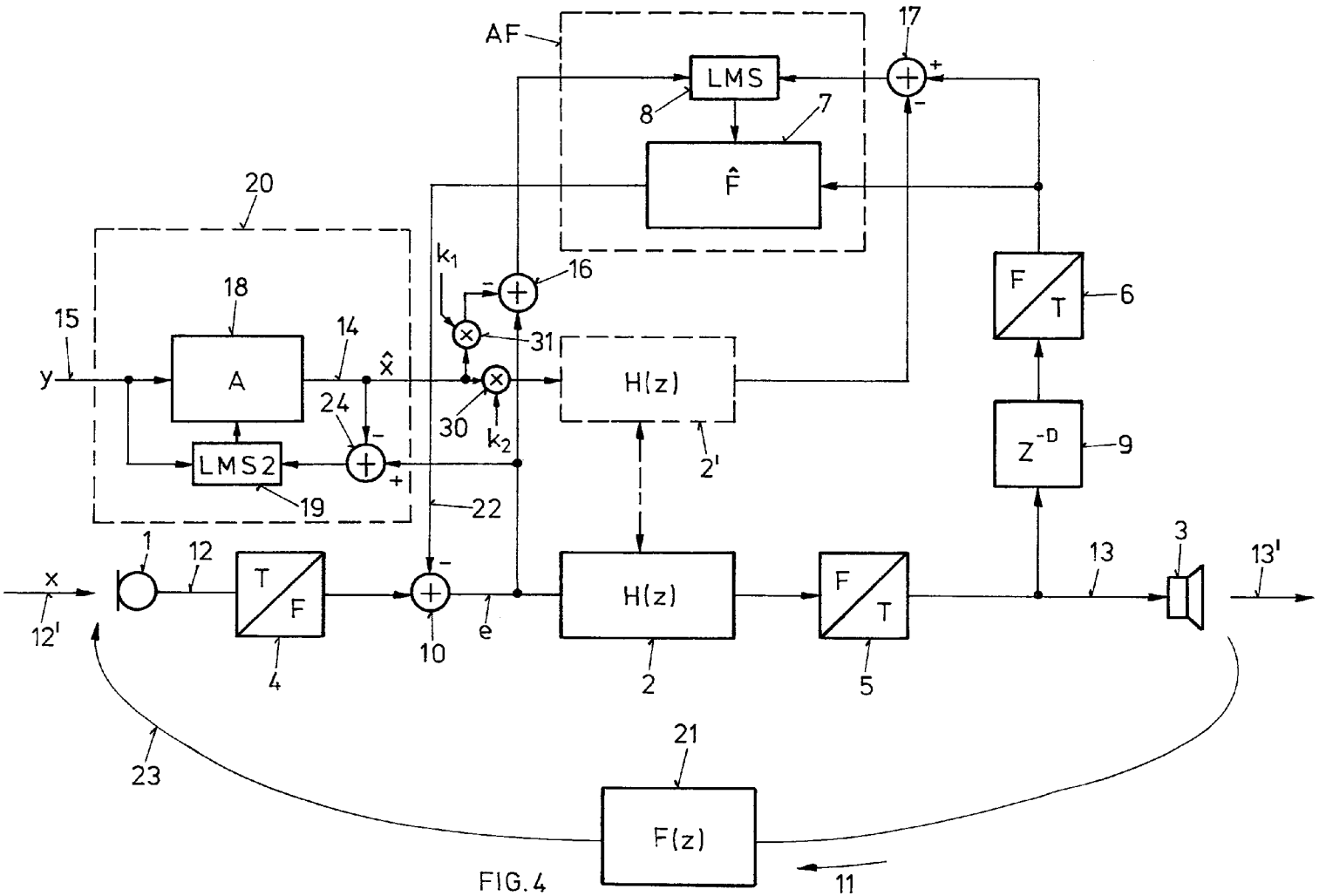
Figure 5:
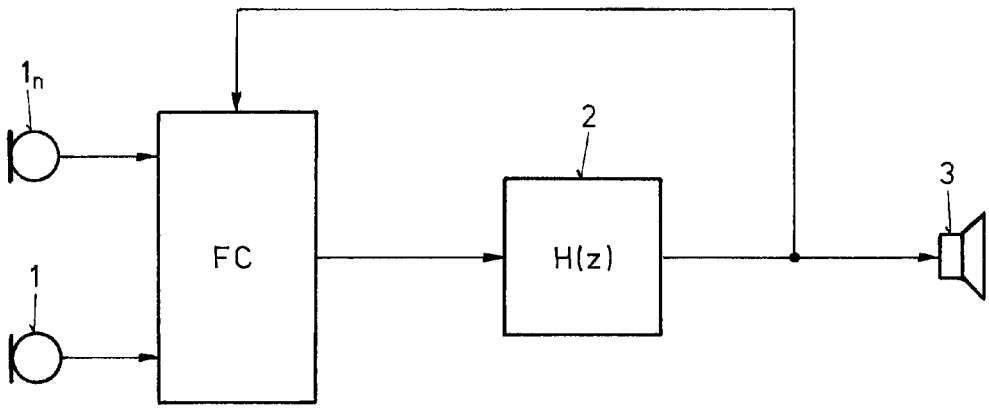
Figure 6:
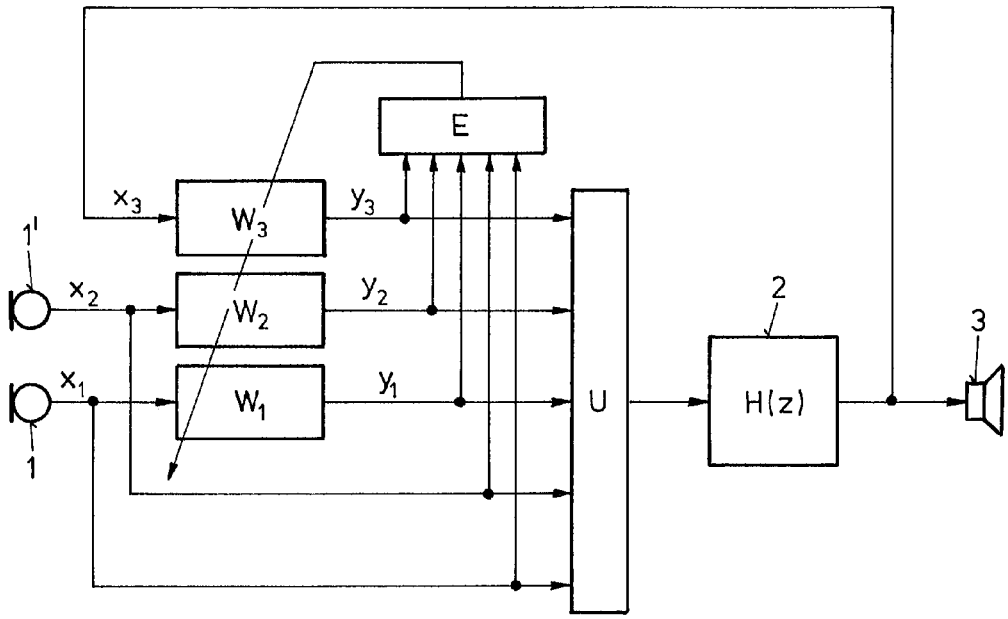

FIG. 1 schematically shows a block diagram of a hearing device with a known feedback cancelling system, FIG. 2 schematically shows a block diagram of a hearing device with a feedback cancelling system according to the present invention, FIG. 3 schematically shows a block diagram of a further embodiment according to the present invention, FIG. 4 schematically shows a block diagram of a still further embodiment according to the present invention, FIG. 5 shows a more generic block diagram of the present invention, and FIG. 6 shows a more detailed block diagram of the generic embodiment of FIG. 5.

A known hearing device with feedback cancelling is depicted in FIG. 1. The known hearing device comprises a microphone 1, a processing unit, in which the transfer function 2 is implemented, and a loudspeaker 3, which is also called receiver in the technical field of hearing devices. In case the signal processing is implemented in the frequency domain, corresponding transformation units are present before and after the transfer function 2, i.e. a time-to-frequency domain transformation unit 4 is provided in-between the microphone 1 and the transfer function 2, and a frequency-to-time domain transformation unit 5 is provided in-between the transfer function 2 and the receiver 3.

The transfer function 2 comprises a gain model, noise canceller, and further elements present in the hearing device. The acoustic feedback path is represented by an external feedback transfer function E(z). The feedback path is estimated by an adaptive filter AF. Because the receiver 3 exhibits a non-linear behavior when driven into saturation, a limiter (not shown in FIG. 1) is used before the receiver 3. An output signal of the transfer function 2 is branched off as a reference signal to the adaptive filter unit AF. An additional delay 9 is inserted that models the processing delay through the time-domain core, the transfer unit 2 and the receiver 3.

The adaptive filter AF comprises an estimated transfer function $\hat{E}$ (reference sign 7) and an adaptive unit 8. The estimated transfer function 7 is adapted by a LMS—(Least-Mean-Square) algorithm, which is implemented in the adaptive unit 8, in which coefficients for the estimated transfer function $\hat{E}$ are updated. The estimated transfer function 7 or its coefficients, respectively, are updated in such a way that the estimated transfer function 7 reflects the external feedback transfer function 21. The more these two function resemble each other, the more accurate the feedback cancelling or feedback preventing is.

In order to adjust the coefficient of the estimated transfer function 7, a difference signal e is calculated between the output signal of the estimated transfer function 7 and the input signal at 12 from the microphone 1. This difference signal e as well as the delayed output signal at 13 is fed to the adaptive unit 8, in which the coefficient for the estimated transfer function 7 is calculated.

Because the input signal at 12 contains the actual input signal 12' as well as the feedback signal at 23, the estimated transfer function 7 or its coefficients, respectively, are adapted incorrectly. This is illustrated by the following situation:

When the input signal is tonal (i.e. highly correlated to a feedback signal), the adaptive filter does not converge to the correct estimate of the external transfer function 21. Instead, the coefficients of the estimated external transfer function 7 are adjusted such that the tonal input signal is cancelled. When the input signal is cancelled, the adaptive filter AF cancels the signal that should have been processed and transmitted. This leads to an uncomfortable roughness and to inharmonic distortions.

Computing the adaptive filter AF in frequency domain has the advantage that the transfer function $\hat{E}$ can be computed in every frequency-band independently. This opens up the possibility to adjust the parameters of the adaptation (step-size, level normalization, etc.) individually for every frequency band. In the literature this approach is called frequency-domain least-mean-squares (FDLMS) adaptive filter.

FIG. 2 schematically shows a block diagram of a hearing device according to the present invention. As in the block diagram of FIG. 1, the hearing device of FIG. 2 comprises a microphone 1, a transfer function unit with a transfer function 2 and a receiver 3. The processing within the hearing device is again performed in the frequency domain. Therefore, corresponding time-to-frequency and frequency-to-time domain transformation units 4 to 6 are provided. In addition, also the delay unit 9 and the adaptive filter AF comprising the estimated external transfer function 7 and the adaptive filter unit 8 are present.

According to the present invention, the input signal 12' ($x$) that is not corrupted by any feedback component of the feedback path is estimated by another adaptive algorithm, which is implemented in a further adaptive filter unit 20. The input signal 12' is also called the actual input signal or the uncor rupted input signal hereinafter. Thereto, an auxiliary signal 15 ($y$) is used that is obtained by one of the following ways:

An output signal of a microphone of a contra-lateral hearing device is used as auxiliary signal 15.

An output signal of a beam former or any signal processing unit (i.e. any combination of microphone signals) of a contra-lateral or remote device can be used as auxiliary signal 15.

A signal picked-up by a remote microphone is used as auxiliary signal 15. The remote microphone can be placed at a location, at which no feedback component of a feedback signal is present.

In general, the auxiliary signal 15 shall not contain any components of the feedback signal 23. In a further embodiment of the present invention, the auxiliary signal 15 additionally contains at least components of the actual input signal 12', or the auxiliary signal 15 is derived from the actual input signal 12'.

The further adaptive filter unit 18 or its parameters are adjusted by an adaptive process implementing, for example, a least-mean-square algorithm. Thereby, the auxiliary input signal 15 is taken into account as well as the difference signal e calculated from the output signal of the estimated transfer function 7 and the input signal at 12. A difference is calculated between the difference signal e and the estimated input signal at 14. For this purpose, a second addition unit 24 is provided with two inputs. To one of the two inputs of the second addition unit 24, the estimated input signal at 14 is fed, whereas to the other input of the second addition unit 24, the difference signal e is fed, wherein the estimated input signal at 14 is inverted before the addition is performed in the second addition unit 24. Thereby, the difference between the estimated input signal at 14 and the difference signal e is obtained. The value for the difference is fed to the adaptive process implemented in the unit 19 and processed in such a manner (by adjusting the transfer function in the further adaptive unit 18) that the value for the difference is minimal. Therewith, the estimated input at 14 is equal or almost equal to the difference signal e.

The estimated input signal at 14—that is uncorrupted by components of the feedback signal 23—is subtracted from the difference signal e, the result of this subtraction being used to adapt the estimated transfer function 7 of the feedback path 11. Thereto, a third addition unit 16 is provided, wherein the estimated input signal at 14 is inverted before it is fed to the third addition unit 16.

For a binaural hearing system comprising a left and a right hearing device, the corresponding adaptive filter unit AF has access to both input signals (i.e. from the microphones) from the contra-lateral hearing device and from the ipsi-lateral hearing device. The further adaptive filter 20 generates, in each hearing device, an estimate of the uncorrupted input signal x and subtracts it from the error signal path for the adaptive filter AF. When the input signal at 12' is perfectly identified (i.e. in case the values for the difference signal e and the estimated input signal 14 are identical), the error signal at the output of the second addition unit 24 consists of the feedback components only (feedback signal 23). Hence, the adaptive filter AF can perfectly adjust the external transfer function 21. As a result thereof, the step of estimating the external transfer function 21 is not corrupted and not influenced by feedback components.

FIG. 3 schematically shows a block diagram of a further embodiment of a hearing device according to the present invention. In contrast to the embodiment depicted in FIG. 2, the embodiment of FIG. 3 comprises a fourth addition unit 17 instead of the third addition unit 16. In addition, the estimated input signal at 14—that is uncorrupted by components of the feedback signal 23—is now subtracted from the reference signal (output signal at 13). Thereto, the fourth addition unit 17 is provided, wherein the estimated input signal at 14 is inverted before it is fed to the fourth addition unit 17. In order to obtain a correct input signal for the adaptive process unit 8, the estimated input signal at 14 must additionally be adapted by the current transfer function 2 before it is fed to the fourth addition unit 17. This is indicated by the unit 2', which has the same transfer function as unit 2 and which is drawn with dashed lines in FIG. 3.

For a binaural hearing system comprising a left and a right hearing device, the corresponding adaptive filter unit AF has access to both input signals (i.e. from the microphones) from the contra-lateral hearing device and from the ipsi-lateral hearing device. The further adaptive filter 20 generates, in each hearing device, an estimated input signal 14 of the uncorrupted input signal x (12') and subtracts it from the reference signal path for the adaptive filter AF. When the input signal at 12' is perfectly identified (i.e. in case the values for the reference signal e and the estimated input signal 14 are identical), the error signal at the output of the second addition unit 24 consists of the feedback components only (signal 23). Hence, the adaptive filter AF can perfectly adjust the external transfer function 21. As a result thereof, the step of estimating the external transfer function 21 is not corrupted and not influenced by feedback components.

FIG. 4 shows a further embodiment of the present invention in that a schematic block diagram of the type according to FIGS. 2 and 3 is shown. In general, the embodiment of FIG. 4 is a generalized implementation of the embodiments of FIGS. 2 and 3 in that the third addition unit 16 as well as the fourth addition unit 17 is provided. In addition, a first multiplication unit 30 and a second multiplication unit 31 is provided, to each of which the estimated input signal at 14 is fed. A second input to the first multiplication unit 30 is a constant value $k_1$, and a second input to the second multiplication unit 31 is a constant value $k_2$, wherein the constant values $k_1$ and $k_2$ are weighting factors having real values out of the set [0 . . . 1]. As an example, $k_1$=0.9 and $k_2$=0.1 to reach a good compromise between entrainment reduction and susceptibility of the feedback canceller.

It is pointed out that the time-to-frequency and frequency-to-time domain transformation units 4 to 6 depicted in FIGS. 2, 3 and 4 are for illustration purposes only. It is also feasible to implement the adaptive filter or filters completely in the time domain. In another embodiment, the estimated filter is in the time domain, whereas the coefficients are updated in the frequency domain.

In a still further embodiment of the present invention, as depicted in FIG. 5, a more generic unit FC receives signals from all microphones 1, . . . , $\mathbf{1}_n$, that are incorporated in the hearing device (contra-lateral and/or ipsi-lateral) and/or that are external to the hearing device. The output of the generic unit FC is the best estimate of the clean input signal, i.e. the one with the lowest feedback distortions, or the one without any feedback distortions, respectively.

A more detailed view of the embodiment according to FIG. 5 is depicted in FIG. 6, in which two microphones 1 and 1' are shown. All input signals $x_1$, $x_2$ and $x_3$ are filtered by corresponding filter units $w_1$, $w_2$ and $w_3$. An error signal is used to adjust the filters in the filter units $w_1$, $w_2$ and $w_3$ jointly, such that the error is minimized. The error is computed as a linear combination of the filter inputs and outputs. The input signal to the hearing device (i.e. the estimated uncorrupted input signal) is computed as a different linear combination.

It is pointed out that the number of microphones and the corresponding filter units is not limited to three, but can be of any number starting from two.

What is claimed is:

1. A method for cancelling or preventing feedback in a hearing device comprising a microphone (1), a transfer function (2) and a receiver (3), wherein the transfer function (2) defines relation between an input signal (12) of the hearing device and an output signal (13, 13') of the hearing device, the method comprising the steps of:

estimating an external transfer function (21) of an external feedback path (11) defined by sound traveling from the receiver (3) to the microphone (1), characterized by comprising the steps of estimating the input signal (12') having no feedback components of the external feedback path (11) using an auxiliary signal (15) comprising no feedback components of the external feedback path (11), and using the estimated input signal (14) for estimating the external transfer function (21) of the external feedback path (11).

2. The method of claim 1, characterized in that an adaptive filter (AF) using a Least-Mean-Square algorithm is implemented for estimating the external transfer function (21).

3. The method of claim 1, characterized by further comprising the steps of calculating an estimated feedback signal (22) using the estimated external transfer function (7) and the output signal (13) of the hearing device, and subtracting the estimated feedback signal (22) from an output signal of the microphone (1), the result of subtracting the estimated feedback signal (22) from the output signal of the microphone (1) being used to adjust the estimated external transfer function (7).

4. The method of claim 1, characterized in that one of the following signals is used as auxiliary signal (15):

an output signal of a microphone of a contra-lateral hearing device;

a combination of output signals of a contra-lateral or a remote microphone;

a signal picked-up by a remote microphone.

5. The method of claim 1, characterized in that a further adaptive filter (20) preferably using a Least-Mean-Square algorithm is implemented for estimating the input signal (12') having no feedback components.

6. The method of claim 1, characterized by further comprising the step of using the input signal (12) of the hearing device for estimating the input signal (12') having no feedback components.

7. The method of claim 3, characterized by further comprising the step of subtracting the estimated input signal (14) weighted by a first factor ($k_1$) from the result of subtracting the estimated feedback signal (22) from the output signal (12) of the microphone (1), the first factor ($k_1$) having a value between 0 and 1, preferably a value of 0.9.

8. The method of claim 3, characterized by further comprising the step of subtracting the estimated input signal (14) or a processed estimated input signal (14) from the output signal (13), the estimated input signal (14) or the processed estimated input signal (14) being weighted by a second factor ($k_2$) that has a value between 0 and 1, preferably a value of 0.1.

9. The method of claim 7, characterized by involving the transfer function (2) in the processing of the estimated input signal (14).

10. A hearing device comprising a microphone (1), a transfer function unit (2) having a transfer function, a receiver (3), means for estimating an external transfer function (21) of an external feedback path (11) defined by sound traveling from the receiver (3) to the microphone (1), wherein the transfer function defines relation between an input signal (12) of the hearing device and an output signal (13, 13') of the hearing device, characterized by further comprising means for estimating the input signal (12') having no feedback components of the external feedback path (11) using an auxiliary signal (15) comprising no feedback components of the external feedback path (11), and operationally connecting the estimated input signal (14) to the means for estimating the external transfer function (21) of the external feedback path (11).

11. The hearing device of claim 10, characterized by further comprising means for calculating an estimated feedback signal (22) using the estimated external transfer function (7) and the output signal (13) of the hearing device, and means for subtracting the estimated feedback signal (22) from an output signal of the microphone (1), the result of subtracting the estimated feedback signal (22) from the output signal of the microphone (1) being used to adjust the estimated external transfer function (7).

12. The hearing device of claim 10, characterized in that the auxiliary signal (15) is one of the following signals:

an output signal of a microphone of a contra-lateral hearing device;

a combination of output signals of a contra-lateral or remote microphone;

a signal picked-up by a remote microphone.

13. The hearing device of claim 10, characterized in that the means for estimating the input signal (12') is a further adaptive filter (20).

14. The hearing device of claim 13, characterized in that the input signal (12) is operationally connected to the further adaptive filter (20).

15. The hearing device of claim 11, characterized by further comprising means for subtracting the estimated input signal (14) weighted by a first factor ($k_1$) from the result of subtracting the estimated feedback signal (22) from the output signal (12) of the microphone (1), the first factor ($k_1$) having a value between 0 and 1, preferably a value of 0.9.

16. The hearing device of claim 11, characterized by further comprising means for subtracting the estimated input signal (14) or a processed estimated input signal (14) from the output signal (13), the estimated input signal (14) or the processed estimated input signal (14) being weighted by a second factor ($k_2$) that has a value between 0 and 1, preferably a value of 0.1.

17. The hearing device of claim 15, characterized in that the estimated input signal (14) is fed to the transfer function unit (2') for processing the estimated input signal (14).

18. The method of claim 8, characterized by involving the transfer function (2) in the processing of the estimated input signal (14).

19. The hearing device of claim 16, characterized in that the estimated input signal (14) is fed to the transfer function unit (2') for processing the estimated input signal (14).

* * * * *